United States Patent [19]

Frings et al.

[11] Patent Number: 4,917,583

[45] Date of Patent: Apr. 17, 1990

[54] BEARING SUPPORT FOR A TWIN-SHAFT PUMP

[75] Inventors: Heinz Frings, Cologne; Karl-Heinz Ronthaler, Zülpich; Ralf Steffens, Cologne, all of Fed. Rep. of Germany

[73] Assignee: Leybold Aktiengesellschaft, Cologne, Fed. Rep. of Germany

[21] Appl. No.: 194,252

[22] Filed: May 16, 1988

[30] Foreign Application Priority Data

May 15, 1987 [EP] European Pat. Off. ..... 87107091.8

[51] Int. Cl.[4] ..... F04C 2/18

[52] U.S. Cl. ..... 418/206

[58] Field of Search ..... 418/191, 205, 206

[56] References Cited

U.S. PATENT DOCUMENTS 3,133,506 5/1964 Luciani ..... 418/206 X
4,293,290 10/1981 Swanson ..... 418/206 X

FOREIGN PATENT DOCUMENTS 165031 10/1954 Australia ..... 418/206
1939717 11/1978 Fed. Rep. of Germany .
3147824 6/1982 Fed. Rep. of Germany .
3312117 10/1984 Fed. Rep. of Germany .
875021 6/1942 France ..... 418/206

*Primary Examiner*—Michael Koczo
*Attorney, Agent, or Firm*—Spencer & Frank

[57] ABSTRACT

A twin-shaft pump includes a working chamber; a first side plate and an opposite, second side plate bounding the working chamber; and two impellers accommodated in the working chamber and each having a first end face and an opposite, second end face. Each first end face is adjacent and oriented toward the first side plate and each second end face is adjacent and oriented towards the second end plate. There are further provided impeller bearings adjacent the first and second end faces of each impeller; and a pump drive situated adjacent the first end faces and being operatively connected to the impellers. A dish-shaped component is situated adjacent at least one of the end faces of at least one of the impellers. The dish-shaped component has an inner wall defining a dish-shaped cavity accommodating an impeller bearing which is in a supporting contact with the inner wall of the component. A stationarily held stub shaft is in alignment with the impeller bearing and projects into the cavity and the impeller bearing received therein for supporting the impeller bearing.

24 Claims, 4 Drawing Sheets

BEARING SUPPORT FOR A TWIN-SHAFT PUMP

BACKGROUND OF THE INVENTION

This invention relates to a twin-shaft pump having a working chamber which accommodates a pair of impellers and which is bounded by bearing plates for supporting the impeller shafts at the radial end faces of each impeller with the interposition of roller bearings or the like. The pump has a power drive which is connected to one of the shafts at the impeller end face from which the driven shaft extends.

A typical twin-shaft pump presently available on the market is disclosed in German Offenlegungsschrift (nonexamined published application) 1,939,717. The pump is a Roots vacuum pump (that is, it operates with interengaging lobed impellers) having the following principal structural components: a top closure, side plates or bearing plates on opposite sides of the working chamber, a housing and a motor flange (motor housing plate). These components have relatively large dimensions and are of relatively heavy weight. They are generally cast components involving labor-intensive finishing work. Installation and maintenance labor too, is intensive because the individual components have to be sealed and tightened to one another. Substantial structural space, large weight, problems in the sealing of the individual components as well as high expenses concerning finishing work, installation and maintenance are thus principal disadvantages of these pump arrangements. The lateral chambers in which the synchronizing drives and the connecting mechanism to the motor shaft are accommodated have relatively large dimensions and form detrimental dead spaces adjacent the working chamber. Furthermore, with increasing frequency, customers specify diverse sealing systems, drive systems or the like, dependent upon the intended particular use of the pump. The construction of known Roots pumps does not favor possibilities for a modular construction.

Further, in known Roots pumps, the shaft seals at the working chamber and the shaft bearings are arranged in an axial series behind one another. This necessitates a relatively large bearing distance, resulting in an increased structural length of the entire pump, an increased bending stress at the impeller shaft ends, an unfavorable dynamic behavior as well as a limited length-to-diameter ratio of the impellers. The structural space available for the working chamber shaft seal is between very narrow limits in the axial direction so that seal assemblies representing diverse sealing principles may be installed only at high expense.

To the twin-shaft pumps of the above-outlined type there further belong single-stage or multi-stage pumps whose impellers have other configurations, as disclosed, for example, in German Offenlegungsschriften 3,147,824 and 3,312,117. Screw-shaped impellers in twin-shaft vacuum pumps are also known. The invention furthermore relates to multistage twin-shaft vacuum pumps whose stages are equipped with differently configured impeller pairs.

SUMMARY OF THE INVENTION

It is an object of the invention to provide an improved twin-shaft vacuum pump of the above-outlined type which is significantly more compact and has a simpler construction than prior art pumps and furthermore permits a modular construction.

This object and others to become apparent as the specification progresses, are accomplished by the invention, according to which, briefly stated, the twin-shaft pump includes a working chamber; a first side plate and an opposite, second side plate bounding the working chamber; and two impellers accommodated in the working chamber and each having a first end face and an opposite, second end face. Each first end face is adjacent and oriented toward the first side plate and each second end face is adjacent and oriented towards the second end plate. There are further provided impeller bearings adjacent the first and second end faces of each impeller; and a pump drive situated adjacent the first end faces and being operatively connected to the impellers. A dish-shaped component is situated adjacent at least one of the end faces of at least one of the impellers. The dish-shaped component has an inner wall defining a dish-shaped cavity accommodating an impeller bearing which is in a supporting contact with the inner wall of the component. A stationarily held stub shaft is in alignment with the impeller bearing and projects into the cavity and the impeller bearing received therein for supporting the impeller bearing.

A twin-shaft pump with an impeller bearing assembly according to the invention as outlined above, has a significantly reduced structural length and thus a substantially diminished weight. The distance of the impeller bearings from one another is less than in conventional vacuum pumps, advantageously affecting the dynamic behavior of the impellers and the length-to-diameter ratio thereof. Further, the pump structured in accordance with the invention facilitates installation and maintenance because the access to the shaft seals is no longer obstructed bY the impeller bearings.

The cavity which accommodates the impeller bearing may be provided in a structural component axially spaced from the respective end face of the impeller or may be provided in the impeller end face itself. In the former case, at the outside of the cavity there is sufficient structural space available for diverse sealing systems. Since the bearing chamber and the shaft seal need no longer be mounted in series, a reduction in the structural length results. In case the cavity is provided in the impeller face, the cavity is sufficiently deep for accommodating the bearing, the shaft seal and possibly also cooling devices without the need of increasing the structural length. In an impeller which is equipped on both sides with a support of this type, the distance of the bearings from one another is smaller than the impeller length, resulting in an advantageous dynamic behavior of the impeller.

DESCRIPTION OF THE PREFERRED EMBODIMENTS

Figure 1:
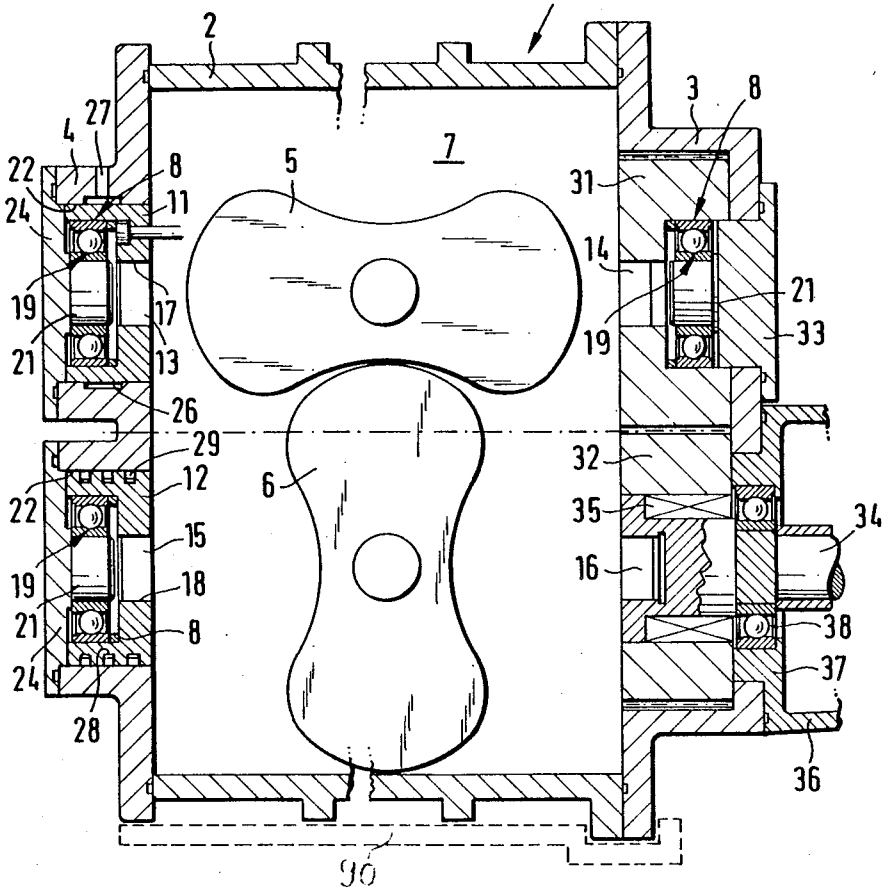
FIG. 1 is an axial side elevational view of components of a Roots vacuum pump incorporating a preferred embodiment of the invention; some of the components being shown in end elevation.

Turning to FIG. 1, there is illustrated a Roots vacuum pump 1 which has essentially the following structural components: a housing 2, a drive-side side plate 3, a side plate 4 situated opposite the drive side and impellers 5 and 6 which rotate in the working chamber 7. It is noted that in FIG. 1, the impellers 5 and 6 are shown in end elevation, rather than in sectional side elevation as the other components of the construction.

For supporting the impellers 5 and 6 on that side which is opposite from the pump drive (not shown in detail) there are provided dish-shaped parts 11 and 12, each having a cavity 8 defined by inner wall portions of the respective parts 11, 12. The impellers 5 and 6 have on each of their radial end faces a respective central stub shaft 13, 14, 15 and 16. The stub shafts 13 and 15 extend into the cavity 8 through a respective bottom aperture 17 and 18 provided in the respective part 11 and 12. The parts 11 and 12 are firmly and centrally secured to the respective end face of the impellers 5 and 6 by means of screws.

Within the dish-shaped parts 11 and 12 there are positioned deep-groove ball bearings 19 each supported on one side by the inner wall of the dish-shaped parts 11 and 12. For supporting the stationary inner ring of each bearing 19, there is provided a shaft stub 21 extending from the exterior into the cavity 8, in alignment with the respective bottom apertures 17, 18.

The side plate 4 has circular apertures defined by inner walls 22 directly surrounding the respective parts 11 and 12. To hermetically close the apertures defined by the walls 22, closure plates 24 are provided to which the stationary stub shafts 21 are affixed. Preferably, the closure plate 24 and the associated stub shaft 21 form a single-piece component.

It is known to utilize seal assemblies working on diverse sealing principles for hermetically closing the working chamber 7 with respect to the bearing chambers. In the conventional twin-shaft vacuum pumps it is necessary to arrange the seal and the bearing in an axially juxtapositioned relationship. In an impeller support according to the invention such a serial arrangement is no longer necessary. On the outer side of the dish-shaped parts 11 and 12, that is, radially outwardly of the shaft bearings, sufficient space is available for accommodating the components of various sealing systems. FIG. 1 illustrates a locking gas seal associated with the dish-shaped part 11. For this purpose, a sealing gas (such as an inert gas) is introduced through an annular channel 26 provided in the inner wall 22 of the side plate 4. A weak gas flow towards the working chamber 7 is continuously maintained, so that the gases (often having corrosive properties) present in the working chamber cannot gain access to the bearing chamber. The dish-shaped part 12, on the other hand, is provided with a piston ring-type labyrinth seal. For this purpose, the outer face of the component 12 has circumferential grooves 28 receiving piston rings 29 which, in turn, engage the inner wall 22 of the side plate 4, thus forming a labyrinth.

On the driving side, in the zone of the side plate 3 there are arranged two meshing spur gears 31 and 32 which ensure the synchronous rotation of the impellers 5 and 6. At the upper impeller 5, the spur gear 31 is provided with a dish-shaped cavity 8 accommodating the impeller bearing 19. The stub shaft 21 supporting the inner ring of the bearing 19 is affixed to a closure 33 held in the side plate 3. A drive shaft 34 which is connected to a non-illustrated drive motor, is affixed to the driving side of the impeller 6 with a screw connection similarly to the earlier-described securement of parts 11 and 12 to the respective impellers 5 and 6. The spur gear 31 is affixed in a similar manner to the impeller 5. It is an advantage of these arrangements that identical impellers may be used. A spur gear 32 is mounted on the drive shaft 34 by means of a conventional tightening element 35 which permits an adjustment of the required play between the impellers 5 and 6. A motor housing plate 36 is tightened to the side plate 3 by means of a flange 37 which surrounds a bearing 38 of the drive shaft 34. This arrangement permits installation in a simple manner of different drive variants (split tube motors, modular motors, or motors with different rpm's). It is the only requirement that end of each motor drive shaft which is to be connected with the impeller 6 has the same, compatible securing means. The motor housing plate 36 is preferably a component which can be easily manufactured.

Figure 2:
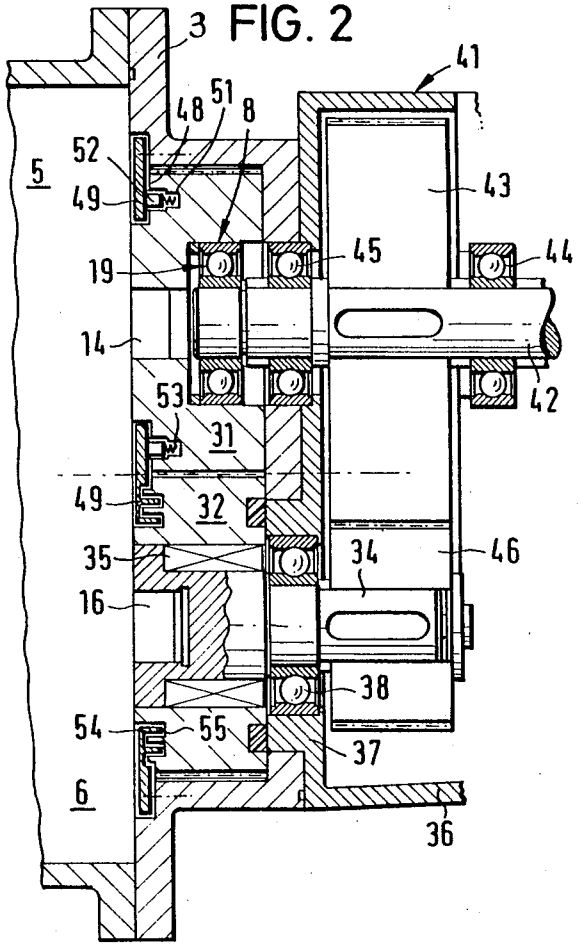
FIG. 2 is a sectional side elevational view similar to FIG. 1, showing additional components of the vacuum pump incorporating a further preferred embodiment of the invention.

Turning now to FIG. 2, there is shown a further embodiment of the invention at the drive side of a twin-shaft pump having a gearing stage 41 between the drive motor and the impeller. Drive shaft 42 carries a first spur gear 43 and is supported by ball bearings 44 and 45. An output spur gear 46 is keyed to a shaft stub 34 which is affixed to the impeller 6 in a manner described in connection with FIG. 1.

FIG. 2 also illustrates further variants for sealing systems which, however, are not limited in use for the synchronizing spur gears 31 and 32. The spur gear 31 has, adjacent the end face of the impeller 5, a radially inwardly oriented stepped portion or shoulder 48, into which extends a component 49 affixed to the side plate 3. In the spur gear face oriented towards the component 49 there is provided an annular recess 51 which accommodates a sealing ring 52 adapted to rotate with the spur gear 31. The sealing ring 52 is biased by a compression spring 53 and is thus pressed against the component 49 to achieve a contact seal.

The spur gear 32 is associated with a labyrinth seal. For this purpose, the stationary component 49 is provided with annular projections and recesses 54 which cooperate with complemental projections and recesses 55 of the spur gear 32.

Figure 3:
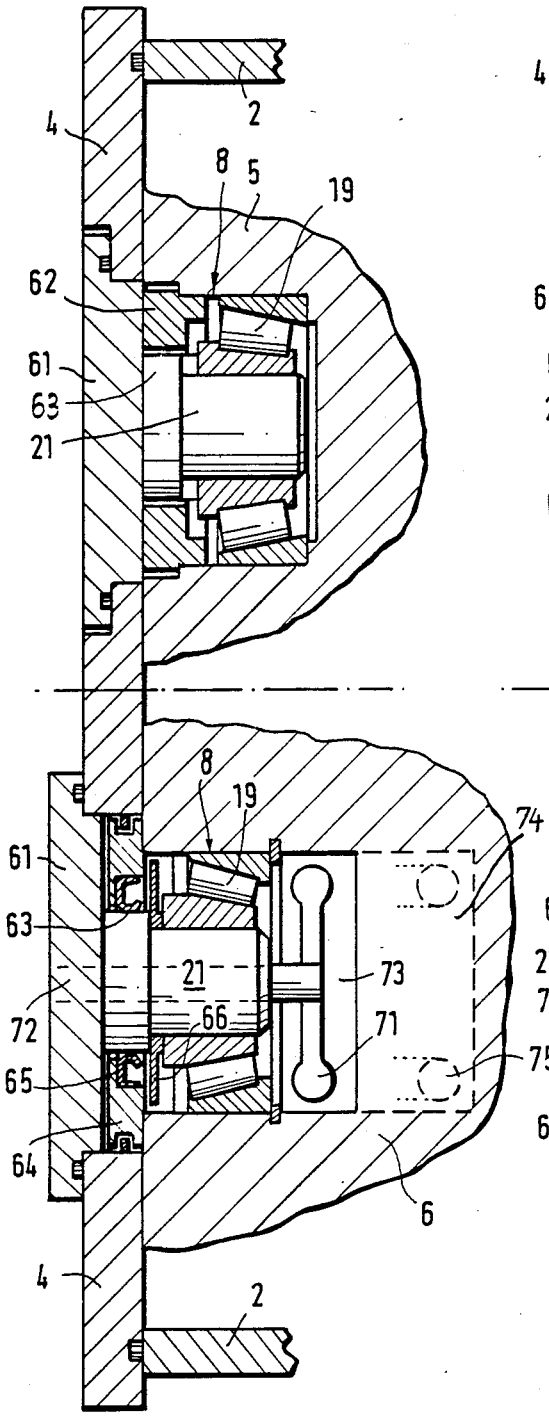
FIGS. 3, 4 and 5 are sectional elevational views of three further preferred embodiments of the invention, provided at the pump side opposite the drive side.

Turning to FIG. 3, there are shown further embodiments for impeller bearings according to the invention, arranged at the pump side opposite to the drive side. The cavities 8 are, in each instance, provided in the respective radial faces of the impellers 5 and 6. These embodiments may be associated with a simple, disc-shaped side plate 4. The bearings 19' are tapered roller bearings.

In the upper portion of FIG. 3, there is illustrated a grease-lubricated version of the impeller bearing. A closure plate 61 carries the stub shaft 21 supporting the inner ring of the bearing 19'. For closing off the bearing chamber there is provided a profiled annulus 62 which forms, with a stepped portion 63 of the stub shaft 21 as well as the closure plate 61, a gap seal (such as a labyrinth seal) and is secured to the impeller 5.

The lower part of FIG. 3 shows an embodiment adapted for oil lubrication. The closure plate 61 carries the cross-sectionally circular stub shaft 21 which supports the inner face of the tapered roller bearing 19'. The stepped portion 63 of the stub shaft 21 is surrounded by a profiled ring 64. Between the ring 64 and the stepped portion 63 there is arranged a radial shaft seal 65 whose sealing lip is oriented towards the stepped portion 63. This arrangement has the following advantages: when the impeller 6 is at a standstill, the sealing lip engages the stepped portion 63 and thus forms therewith a contact seal which prevents oil from escaping from the bearing chamber (that is, the cavity 8). When the impeller 6 rotates, the oil accumulates in the radially outer zone of the cavity 8 by virtue of centrifugal forces, at which time the ring 64 arranged coaxially with the impeller-supporting stub shaft 21, prevents oil from escaping from the cavity 8 by virtue of its inner rim closely surrounding the stepped portion 63 and by virtue of the affixation of the ring 64 to the impeller 6. The centrifugal force has the further effect that the sealing lip of the co-rotational shaft seal 65 lifts off the stepped portion 63 and is thus converted into a contactless seal. This significantly increases the service life of the seal. Additionally, the ring 64 may form gap seal with the closure plate 61. Between the bearing 19' and the shaft seal 65 there is provided a further ring 66 which engages the stationary stub shaft 21 with its inner face. Its outer peripheral edge extends to the radially outwardly located zone of the cavity 8 and, when the impeller 6 rotates, projects into the lubricating oil which accumulates in that zone. The oil and the ring 60 thus form a dynamic seal which isolates the bearing chamber from gases in the working chamber of the vacuum pump.

The embodiment illustrated in the lower portion of FIG. 3 further comprises a cooling arrangement serving the bearing 19' and the impeller 6. The cooling arrangement comprises a stationary cooling ring 71 which is connected with the stub shaft 21 and is supplied with coolant from a channel 72. The cavity 8 provided in the impeller 6 for receiving the bearing 19' is therefore deepened by a chamber 73 accommodating the cooling ring 71. The cooling ring 71 is situated in a radially outermost annular zone of the chamber 73 to ensure that when the impeller 6 rotates, the lubricating oil accumulating in that zone may form a heat-conducting bridge between the cooling ring 71 and the impeller 6. The chamber 73 may have an extension 74 (shown in phantom lines) which is needed in case, instead of a single cooling ring 71, a cooling coil 75 is to be provided.

Figure 4:
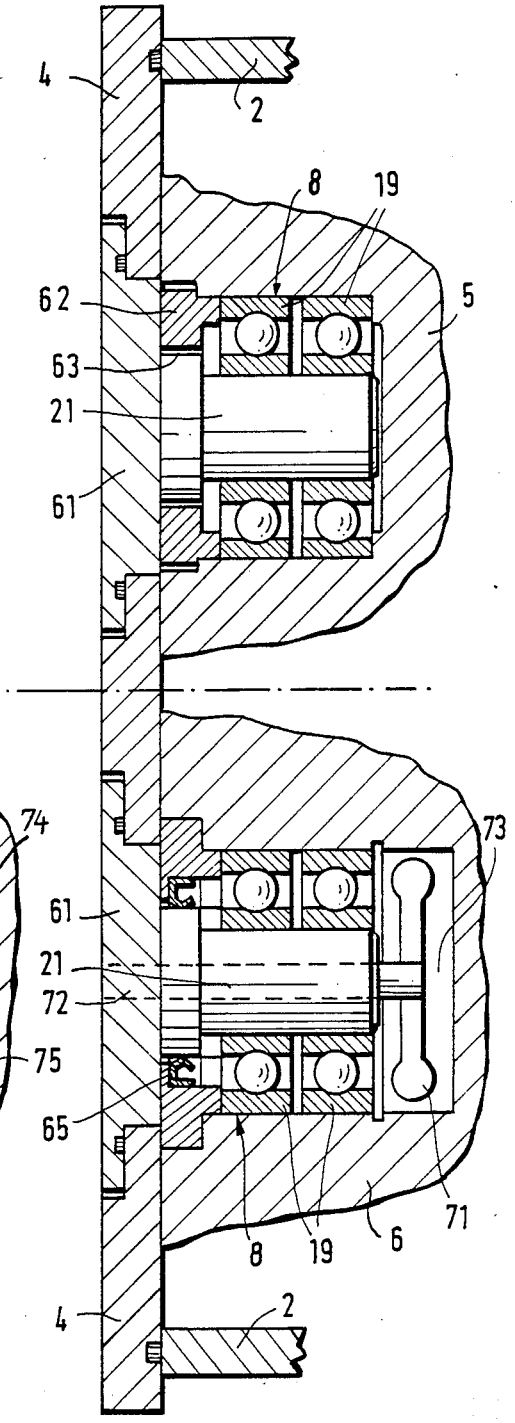

FIG. 4 illustrates a further embodiment of the invention, wherein impeller bearings 19 (deep-groove roller bearings) are accommodated in cavities 8 provided in the radial faces of the respective impellers 5 and 6. The upper portion of FIG. 4 shows a version adapted for grease lubrication, having a gap seal bounding the bearing chamber and formed of a profiled ring 62 and a stepped portion 63 of the stub shaft 21. The lower portion of FIG. 4 shows a version for oil lubrication, having a shaft seal 65 for sealing the bearing chamber. There is further provided a cooling arrangement which is formed of a cooling ring 71 in the chamber 73, supplied with coolant through a channel 72 which passes through the closure plate 61 and the stub shaft 21.

Figure 5:
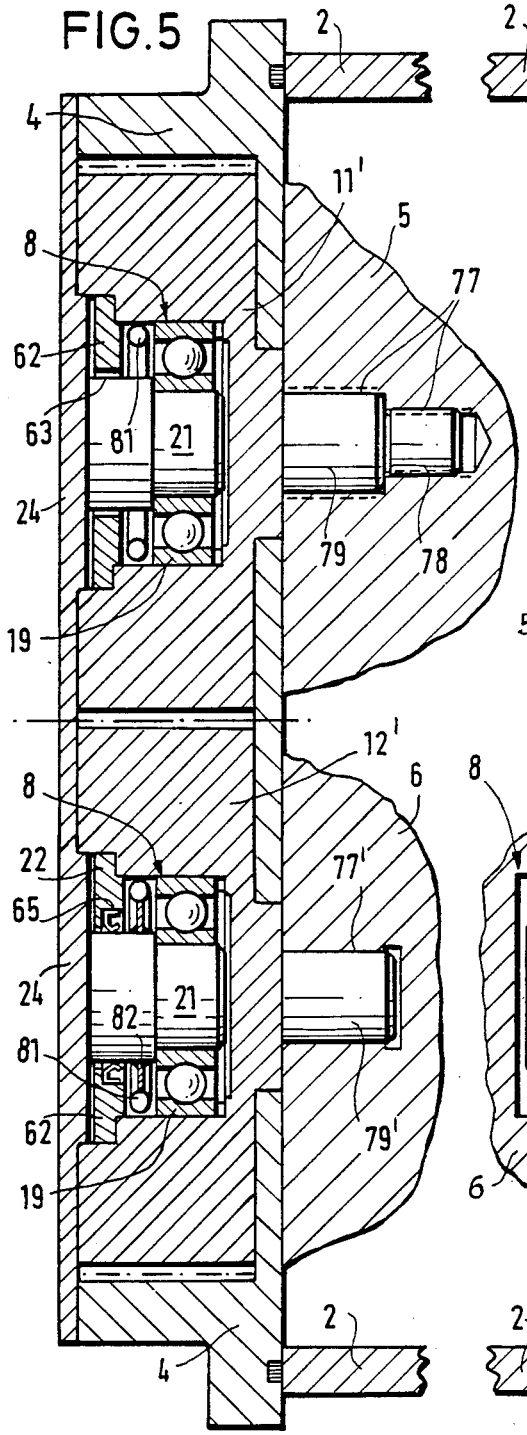

Turning to FIG. 5, there are shown impeller bearings wherein the dish-shaped parts 11' and 12' each having dish-shaped cavities 8 are provided at the respective impeller face. The components 11' and 12' are spur gears with identical diameter and form the synchronizing drive for the impellers 5 and 6.

In the upper part of FIG. 5 there is shown a version adapted for grease lubrication. The bearing chamber (cavity 8) is closed off by a profiled ring 62 which forms a gap seal with the stepped portion 63 of the stub shaft 21. Additionally, in the bearing chamber, between the profiled ring 62 and the bearing 19, there is provided a cooling ring 81 which is supplied with a coolant through the stub shaft 21 in a manner not shown in detail. The cooling ring 81 constitutes an additional protection against the lubricant gases emanating from the bearing chamber. Additionally, in the upper portion of FIG. 5, there is provided the possibility to connect the component 11' with the impeller 5 irrespective of whether the component 11' also functions as a spur gear. In the impeller 5 there is provided a stepped recess 77 whose inner (deeper) portion is provided with a thread 78. To the component 11' there is affixed a stub shaft 79 having a configuration complemental to the depression 77. The stub shaft 79 centers the component 11' and the impeller 5 relative to one another, whereas the thread 78 serves for securing both components 5 and 11' to one another.

The lower portion of FIG. 5 shows a version for an oil lubrication. Instead of a gap seal there is provided a radial shaft seal 65 structured similarly to that described in connection with FIGS. 3 and 4. The cooling ring 81 (which is situated in the radially outer zones of the cavity 8) is connected by means of a closed ring web 82 with the stub shaft 21 so that the cooling ring 81 — similarly to the ring 68 shown in FIG. 3 — forms a dynamic seal with an outer oil ring. This arrangement also provides for an effective cooling of the oil. In the impeller 6 there is provided a bore 77' in which a stub shaft 79' affixed to the component 12' is secured and centered by a threaded connection 80. The stub shaft 79' may be cylindrical or conical for centering purposes.

The embodiments illustrated in FIGS. 3, 4 and 5 are advantageous not only in that they make possible the use of identical impellers, but also in that they permit the impellers to be made from severed blanks produced by continuous casting, because stub shafts are not required for the impellers.

Figure 6:
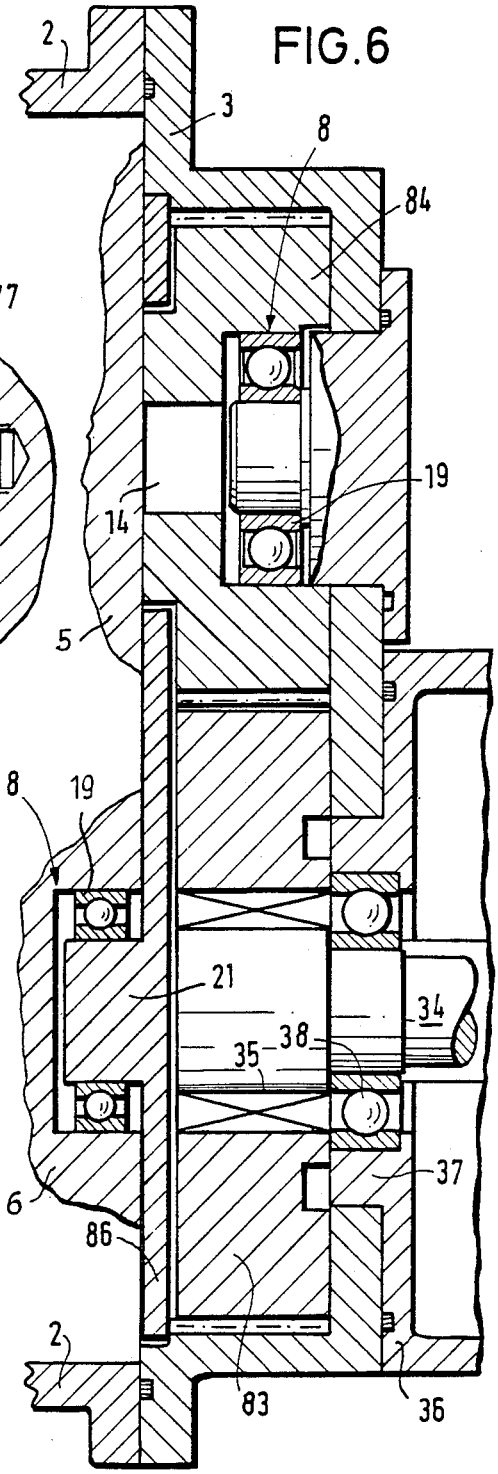
FIGS. 6, 7, 8 and 9 are sectional elevational views of four additional preferred embodiments arranged at the drive side of the pump.

Turning now to the embodiment illustrated in FIG. 6, there is illustrated therein in section the side plate 3 on the driving side, carrying a drive gear stage formed of spur gears 83 and 84. Such a drive-side assembly may be combined with a synchronizing drive which is situated at the other side of the impellers, as shown, for example, in FIG. 5. For supporting the motor shaft 34, there is provided a bearing 38 seated in the flange 37 of the motor housing plate 36. The end of the shaft 34 is connected by a tightening element 35 with the spur gear 83. The bearing 19 of the impeller 6 is situated in the cavity 8 which is provided in the radial face of the impeller 6. The stationary ring of the bearing 19 is supported on the stub shaft 21 which, in turn, projects into the cavity 8. The stub shaft 21 is attached to a plate 86 which is situated between the impeller 6 and the spur gear 83 and which is secured to the side plate 3 by means of a non-illustrated screw connection.

Figure 7:
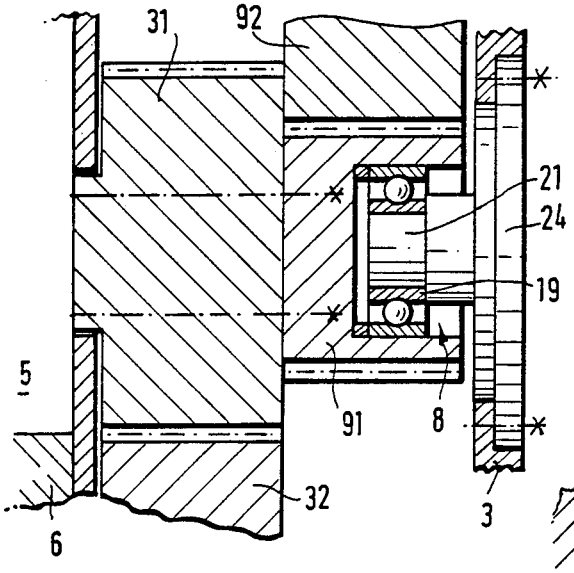

At the drive-side support shown in FIG. 7, an output spur gear 91 of a gearing 91, 92 and the associated synchronization spur gear 31 are secured to the impeller 5 in axial alignment with one another. In the outer output gear 91 a cavity 8 is provided which accommodates the bearing 19 in a manner described before. The input spur gear 92 is expediently mounted — in a manner not shown — on the drive shaft of an electromotor while for the support of the impeller 6 there may be provided a cavity (not shown) in the second synchronizing spur gear 32, similarly to the spur gear 31 illustrated in FIG.

1. In this manner, accommodations and supports for all four impeller bearings are designed in accordance with the invention.

Figure 8:
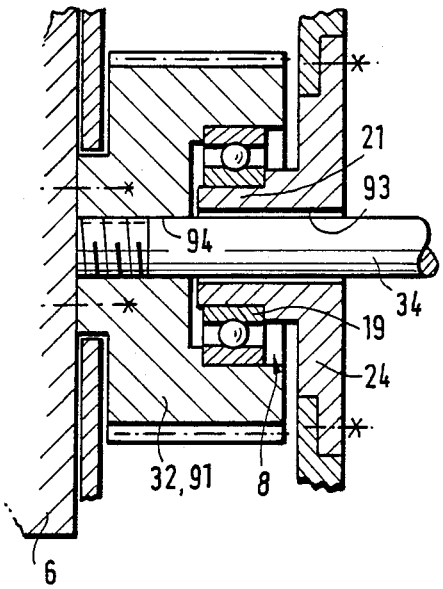

Turning to FIG. 8, there is shown the drive-side support of the impeller 6 with the aid of the cavity 8 formed in the synchronizing or driving spur gear 31, 92, and, at the same time, the drive shaft 34 is coupled to the impeller 6. For this purpose, the closure plate 24 and the stub shaft 21 are provided with a central bore 93 and the spur gear 32 is provided with a central bore 94 through which the guide shaft 34 extends which, at its end, is fixedly connected with the impeller 6. In such an arrangement too, all four impeller supports may be designed according to the invention, for exhibiting the described advantages.

Figure 9:
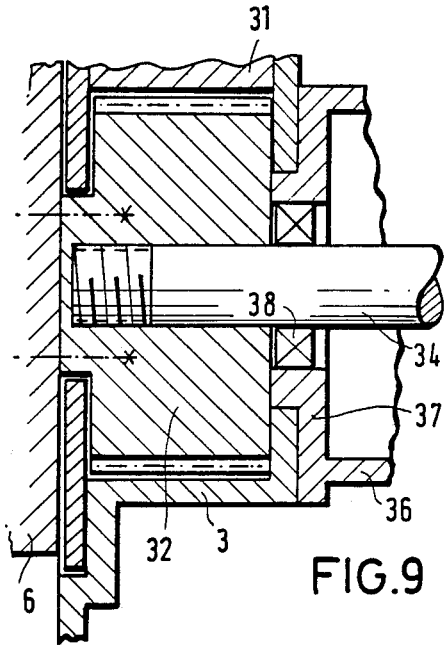

Turning to FIG. 9, there is shown a drive-side support wherein the impeller support of the driven impeller also serves as the pump-side drive shaft support. The drive shaft 34 is inserted into the synchronizing spur gear 32 fixedly attached to the impeller 6 and is supported by the flange 37 of the motor housing plate 36 with the intermediary of the bearing 38 which simultaneously constitutes the impeller bearing. In this embodiment the location for the attachment of diverse motors may be situated behind the already-synchronized drive means without interfering with the synchronization. Furthermore, components such as two motor bearings and a drive-side impeller bearing which would constitute an over-definition of the arrangement are dispensed with.

Basically, a twin-shaft vacuum pump according to the invention has a significantly simpler construction than conventional pumps of this type. Cast components which have been required heretofore may be replaced by turned parts. The number of sealing grooves which have to be present in cast components is significantly reduced, resulting in important manufacturing advantages. The side plate 4 and the housing 2 may be made as a one-piece component so that the number of the parts to be made and the zones to be sealed are further reduced. The compact construction and the reduced weight eventually lead to a reduced price of the machine.

By virtue of the cooling devices which have been described in connection with some of the embodiments, the thermal operational safety is increased. The temperature of the impellers which rotate in a vacuum in a contactless manner does not increase to such an extent as in conventional twin-shaft vacuum pumps and therefore an actual contact of the impellers with the surrounding housing which can transfer heat significantly better than the impellers, is reduced. In particular cases it may be expedient to prevent an excessive heat transfer of the housing by means of an encapsulation 90 shown in FIG. 1. A uniform expansion of the impellers and the housing is thereby achieved, that is, an excessive temperature difference and the resulting thermal expansion differences between impeller and housing — caused by differences in the heat transfer — is thus avoided. By virtue of the cooling devices provided in the bearing zones, excessive temperature differences across the bearings and excessive absolute bearing temperatures are avoided.

It will be understood that the above description of the present invention is susceptible to various modifications, changes and adaptations, and the same are intended to be comprehended within the meaning and range of equivalents of the appended claims.

What is claimed is:

1. In a twin-shaft pump including means defining a working chamber; said means including a first side plate and an opposite, second side plate;

two impellers accommodated in said working chamber and each having a first end face and an opposite, second end face; each said first end face being adjacent and oriented toward said first side plate and each said second end face being adjacent and oriented towards said second side plate;

a separate impeller bearing adjacent the first and second end faces of each said impeller; and a pump drive situated adjacent the first end faces and being operatively connected to the impellers;

the improvement comprising a dish-shaped component situated adjacent at least one of the end faces of at least one of said impellers; said dish-shaped component having a wall defining a dish-shaped cavity accommodating one of said impeller bearings and being situated externally of said at least one impeller; said impeller bearing being in a supporting contact with said wall; and a stationarily held stub shaft being in alignment with said one impeller bearing and projecting into said cavity and the impeller bearing received therein for supporting said impeller bearing.

2. A twin-shaft pump as defined in claim 1, wherein the pump is a vacuum pump.

3. A twin-shaft pump as defined in claim 1, wherein said wall is a radially inner wall, further wherein said dish-shaped component has a radially outer wall; further comprising an annular housing component surrounding said dish-shaped component; said annular housing component having a radially inner wall defining a seal together with said radially outer wall of said dish-shaped component.

4. A twin-shaft pump as defined in claim 3, wherein said seal is a contactless labyrinth seal.

5. A twin-shaft pump as defined in claim 3, wherein said seal is a contacting seal.

6. A twin-shaft pump as defined in claim 1, wherein said dish-shaped component has an external annular stepped portion receiving an annular axial seal.

7. A twin-shaft pump as defined in claim 1, further wherein said at least one impeller has an axial guide bore extending axially inwardly into the impeller from said at least one end face thereof; further comprising an additional stub shaft affixed to said dish-shaped component and projecting into said guide bore; said additional stub shaft being secured to said at least one impeller in said guide bore by a threaded connection.

8. A twin-shaft pump as defined in claim 1, further comprising a synchronizing gear secured to said at least one impeller in axial alignment with said drive gear; said synchronizing gear being flanked by the impeller and the drive gear.

9. A twin-shaft pump as defined in claim 1, wherein said bearing situated in said cavity is oil-lubricated; further comprising a radial shaft seal sealing said cavity from the exterior.

10. A twin-shaft pump as defined in claim 9, wherein said shaft seal has a sealing lip surrounding said stub shaft for cooperating therewith.

11. A twin-shaft pump as defined in claim 10, wherein said sealing lip has an inherent resilient force oriented radially inwardly for pressing the sealing lip circumferentially against said stub shaft; said inherent resilient force being designed such that it is overcome by centrifugal forces generated during rotation of the impeller, whereby the sealing lip lifts off said stub shaft.

12. A twin-shaft pump as defined in claim 11, further comprising a ring surrounding said stub shaft and being interposed between said shaft seal and said bearing; said ring forming, during rotation of the impeller, a dynamic seal with lubricating oil contained in said cavity.

13. A twin-shaft pump as defined in claim 1, wherein said pump drive comprises a drive shaft; further comprising a gear wheel affixed to said at least one impeller in axial alignment therewith; said gear wheel constituting said dish-shaped component; further comprising aligned axial bores in said gear wheel and in said stub shaft; said drive shaft passing through said axial bores.

14. A twin-shaft pump as defined in claim 1, wherein said dish-shaped component is situated adjacent the second end face of said at least one impeller; said pump drive comprising a drive shaft attached to one of said impellers at said first end face thereof; further comprising a drive shaft bearing supporting said drive shaft in said first side plate, said drive shaft bearing simultaneously constituting an impeller bearing.

15. A twin-shaft pump as defined in claim 1, further comprising cooling means disposed in said cavity for cooling the bearing accommodated in said cavity.

16. A twin-shaft pump as defined in claim 15, wherein said cooling means comprises a cooling ring attached to said stub shaft and channel means passing through said stub shaft for supplying said cooling ring with a coolant.

17. A twin-shaft pump as defined in claim 16, further wherein said cooling ring extends in said cavity in a radially outer zone thereof.

18. A twin-shaft pump as defined in claim 17, further comprising a sealing ring surrounding said stub shaft; said cooling ring being interposed between said sealing ring and said bearing situated in said cavity; further comprising a web supporting said cooling ring on said stub shaft; said web and said cooling ring substantially obturate said cavity.

19. A twin-shaft pump as defined in claim 1, further comprising a pump housing; said second side plate and said motor housing being of a single-piece construction.

20. A twin-shaft pump as defined in claim 1, further comprising a pump housing supporting said first and second side plates; and a capsule at least partially surrounding said pump housing for reducing heat transfer by said pump housing.

21. In a twin-shaft pump including means defining a working chamber; said means including a first side plate and an opposite, second side plate;

two impellers accommodated in said working chamber and each having a first end face and an opposite, second end face; each first end face being adjacent and oriented toward said first side plate and each said second end face being adjacent and oriented towards said second side plate;

a separate impeller bearing adjacent the first and second end faces of each said impeller; and a pump drive situated adjacent the first end faces and being operatively connected to the impellers;

the improvement comprising a dish-shaped component situated adjacent at least one of the end faces of at least one of said impellers; said dish-shaped component having a wall defining a dish-shaped cavity accommodating one of said impeller bearings; said impeller bearing being in a supporting contact with said wall;

a stationarily held stub shaft being in alignment with said one impeller bearing and projecting into said cavity and the impeller bearing received therein for supporting said impeller bearing; and a synchronizing gear secured to said at least one impeller; said synchronizing gear constituting said dish-shaped component.

22. In a twin-shaft pump including means defining a working chamber; said means including a first side plate and an opposite, second side plate;

two impellers accommodated in said working chamber and each having a first end face and an opposite, second end face; each said first end face being adjacent and oriented toward said first side plate and each said second end face being adjacent and oriented towards said second side plate;

a separate impeller bearing adjacent the first and second end faces of each said impeller; and a pump drive situated adjacent the first end faces and being operatively connected to the impellers; said pump drive including a drive gear secured to said at least one impeller;

the improvement comprising a dish-shaped component constituted by said drive gear and being situated adjacent at least one of the end faces of at least one of said impellers; said dish-shaped component having a wall defining a dish-shaped cavity accommodating one of said impeller bearings; said impeller bearing being in a supporting contact with said wall; and a stationary held stub shaft being in alignment with said one impeller bearing and projecting into said cavity and the impeller bearing received therein for supporting said impeller bearing.

23. In a twin-shaft pump including means defining a working chamber; said means including a first side plate and an opposite, second side plate;

two impellers accommodated in said working chamber and each having a first end face and an opposite, second end face; each said first end face being adjacent and oriented toward said first side plate and each said second end face being adjacent and oriented towards said second side plate;

a separate impeller bearing adjacent the first and second end faces of each said impeller; and a pump drive situated adjacent the first end faces and being operatively connected to the impellers;

the improvement comprising a separate dish-shaped component situated adjacent each said second end face and adjacent at least one of said first end faces; said dish-shaped component having a wall defining a dish-shaped cavity accommodating one of said impeller bearings; said impeller bearing being in a supporting contact with said wall; and a stationarily held stub shaft being in alignment with said one impeller bearing and projecting into said cavity and the impeller bearing received therein for supporting said impeller bearing.

24. In a twin-shaft pump including means defining a working chamber; said means including a first side plate and an opposite, second side plate;

two impellers accommodated in said working chamber and each having a first end face and an opposite, second end face; each said first end face being adjacent and oriented toward said first side plate and each said second end face being adjacent and oriented towards said second side plate;

a separate impeller bearing adjacent the first and second end faces of each said impeller; and a pump drive situated adjacent the first end faces and being operatively connected to the impellers;

the improvement comprising a dish-shaped component situated adjacent at least one of the end faces of each of said impellers; each said dish-shaped component being affixed to a respective said impeller; each said dish-shaped component having an inner wall defining a dish-shaped cavity accommodating one said impeller bearing; said impeller bearing being in a supporting contact with said inner wall; and a stationarily held stub shaft being in alignment with said one impeller bearing and projecting into said cavity and the impeller bearing received therein for supporting said impeller bearing.

* * * * *